US008276633B2

(12) United States Patent
Meinzinger

(10) Patent No.: US 8,276,633 B2
(45) Date of Patent: Oct. 2, 2012

(54) LABELLING MACHINE

(75) Inventor: Rupert Meinzinger, Kirchroth (DE)

(73) Assignee: Krones AG, Neutraubling (DE)

( * ) Notice: Subject to any disclaimer, the term of this patent is extended or adjusted under 35 U.S.C. 154(b) by 523 days.

(21) Appl. No.: 12/267,070

(22) Filed: Nov. 7, 2008

(65) Prior Publication Data

US 2009/0120588 A1 May 14, 2009

(30) Foreign Application Priority Data

Nov. 14, 2007 (DE) ..... 10 2007 054 728

(51) Int. Cl.
*B65C 9/00* (2006.01)

(52) U.S. Cl. ..... 156/367; 439/135; 439/137; 439/138

(58) Field of Classification Search ..... 156/367, 156/538; 439/135, 138, 137
See application file for complete search history.

(56) References Cited

U.S. PATENT DOCUMENTS 5,372,515 A * 12/1994 Miller et al. ..... 439/138
2005/0034423 A1 * 2/2005 Sindermann et al. ..... 53/136.1

FOREIGN PATENT DOCUMENTS

DE 3409259 C1 * 6/1985
DE 197 41 476 3/1999
WO WO-2005/068302 A1 7/2005

OTHER PUBLICATIONS

Etikettiertechnik, KRONES Modul-Etikettiermaschinen ("Labelling Technology" KRONES Modular Labelling Machines), printing date May 2004.

* cited by examiner

*Primary Examiner* — Khanh P Nguyen
*Assistant Examiner* — John Blades
(74) *Attorney, Agent, or Firm* — Marshall, Gerstein & Borun LLP

(57) ABSTRACT

A labelling machine for containers, including a basic machine provided with a docking station for a labelling unit, the labelling unit being adapted to be docked to and undocked from a target position at the basic machine with a predetermined sequence of relative movements, and respective media connector parts being arranged on the basic machine and on the labelling unit, respectively, and adapted to be coupled to one another. The media connector parts are implemented in such a way that and are arranged on the labelling unit and the docking station with respect to the target position in such a way that they are adapted to be automatically coupled by means of the docking sequence of movements and automatically decoupled by means of the undocking sequence of movements.

11 Claims, 2 Drawing Sheets

LABELLING MACHINE

CROSS-REFERENCE TO RELATED APPLICATION

The present application claims the benefit of priority of German Patent Application No. 102007054728.7, filed Nov. 14, 2007. The entire text of the priority application is incorporated herein by reference in its entirety.

FIELD OF THE DISCLOSURE

The disclosure relates to a labelling machine, such as used in beverage bottling operations.

BACKGROUND

The information brochure "Etikettiertechnik, KRONES Modul-Etikettiermaschinen" (Labelling Technology "KRONES Modular Labelling Machines"), printing date 05/04, of the firm Krones AG, D-93073 Neutraubling/DE, explains on page 15 a vertically adjustable docking station for docking a labelling unit to the basic machine. The associated picture on page 15 shows the known principle of mounting on the labelling unit at least one connector part e.g. for electric supply current of e.g. a drive of the unit. Also in the area of the docking station connected connector parts are shown. The labelling unit does not only need electric supply current for a drive motor, but, in most cases, it also needs other media, such as pressurized air, pneumatic pressure, control signals or synchronizing data information. For each of these media the labelling unit is provided with individual connection and connector parts, which have manually attached thereto suitably implemented connector parts or couplings during or after the docking operation (page 6 of the brochure). The connections established are shown in the picture on page 3 of the brochure. Thanks to a modular design comprising individual assemblies, such labelling machines allow various configurations. For example, various labelling units can selectively be connected to the labelling machine in varying numbers according to requirements (cold glue and hot glue units, label applicators for self-adhesive labels, labelling units for different types of labels, label printing units, and the like). This meets the beverage industry's call for utmost processing flexibility with different container types, when bottles or other containers are labelled. Advantages of this labelling machine are a compact design, easy accessibility, a significant increase of efficiency in the case of frequent decoration changeovers and, all in all, a drastic reduction of costs for the user. Establishing the connection of the connector parts by hand is time-consuming and necessitates special care, since the connector element or elements in the respective connector part must first be exposed before the connection can be established. Exposed connector elements increase the operational risk for the staff, since high current or voltage values are necessary in some cases, and they may get dirty or damaged by mistake. In addition, a plurality of connections has to be established for the various media. These are serious disadvantages as regards setup or changeover times which should be as short as possible, since the configuration principle of the labelling machine precisely aims at the highest flexibility and short setup or changeover times.

Additional prior art is disclosed in DE-A-197 41 476 and WO 2005/068302-A.

SUMMARY OF THE DISCLOSURE

The disclosure is based on the task of improving a labelling machine of the type specified at the beginning insofar as the establishment of the connections for media transfer is simplified and can be executed automatically with reduced operational risks.

The connector parts for the media connections are already arranged stationarily on the labelling unit and on the docking station with respect to the target position of the labelling unit in the connected condition in such a way that the docking sequence of movements can be used for automatically establishing the connection and for automatically separating it during undocking. The connector elements are also configured such that a direct manipulation of the connector part by the operator will no longer be necessary. Since the media connection is already established during docking and is separated during undocking, when the labelling unit is moved to the target position or away from said target position, additional manual operations for establishing the connection can be dispensed with and the expenditure of time as well as the efforts entailed by such manual operations are no longer necessary. This also leads to an increase in operational safety, since the operating staff need no longer manipulate the connector parts, and since said connector parts can also be arranged such that they will no longer get dirty or endanger the operating staff when the connector elements are exposed. Setup and changeover times are reduced, since the labelling machine will be operable as soon as the labelling unit has been correctly connected thereto and since time for separating the connections will no longer be necessary when a labelling unit has been removed.

According to an expedient embodiment at least the connector part arranged on the docking station is provided with a protective cover which, during docking and undocking, is movable between a protective covering position for the connector element or connector elements in the connector part and a passive position allowing the media connection to be established. The protective cover is preferably displaced automatically by the sequence of movements during docking and undocking. When the labelling unit has been undocked, operational risks for the operating staff caused by exposed connector elements no longer exist. This is important, since the supply voltage values required are e.g. values of up to 400 volts. In addition, the connector element or connector elements in the connector part are protected against dirt or short circuiting at least at the docking station, since, in the non-used condition of said docking station, the protective cover will protect them against the influence of cleaning fluids or the like. The protective cover can be secured against manipulations so as to exclude possible risks that may arise when the cover is opened inadvertently in the undocked condition of the labelling unit, said protection against manipulation being e.g. accomplished by detecting the opening movement of the protective cover by means of a sensor and by switching the interior of the docking station to zero-potential, when the labelling unit is not connected.

According to another embodiment, the sequence of movements taking place during docking and undocking of the labelling unit is used for establishing the media connection in such a way that an essentially linear approach movement of the labelling unit towards the basic machine and the docking station will suffice to move the protective cover at least partially to the passive position so as to expose an opening of the connector part, whereas an essentially linear, preferably vertical lifting movement of the docking station and/or lowering movement of the labelling unit will connect the connector parts and establish the media connection or media connections, said lifting and/or lowering movements taking place approximately transversely to the approach movement. This means that the structural design and the positioning of the connector parts is adapted to the sequence of movements in such a way that the normal sequence of movements can be maintained and that the connection can nevertheless be established without any delay being caused.

According to a particularly expedient embodiment, the labelling unit and the docking station each have arranged thereon a connector part with at least one interior connector element including a plurality of media terminals for various media, the connector part defining a housing which protects these media terminals and which has connected thereto a plurality of media lines. The various media can e.g. be the following ones: electric supply current, pressurized air, hydraulic medium, water, electric information, signals or data messages and the like. It will be expedient to transfer the various media centrally via the two interconnected connector parts. The connection lines to the connector parts can then be optimally protected and they can have an optimum short length, since, other than in the case of the manual handling executed in the prior art, there is no need of using excess cable lengths or freely movable cables or hoses or lines for manual manipulations in connection-establishing and separating processes and for relative movements between the docking station and the labelling unit prior to the separation of the connections.

According to an expedient embodiment, the protective cover of the connector part is a protective lid and an elastic sealing frame is arranged on the protective lid, and/or around or on or in the opening, said elastic sealing frame closing the opening of the connector part on all sides thereof when the protective cover occupies the protective position. In the protective position of the protective cover a hermetic sealing effect is produced. One advantage of this solution is that, in the undocked condition of the labelling unit, the connector element or connector elements of the connector part on the docking station are protected against thoughtless or accidental access or against a collision with objects, and that no manipulations whatsoever are necessary for attaching and removing the protective cover, since only the given sequence of movements taking place during docking and undocking is used for this purpose.

According to an advantageous embodiment, the protective lid of the protective cover is movably supported on the connector part via an articulation mechanism in such a way that, when moving to the protective position, the protective cover is adapted to be pressed onto the opening of the connector part or the sealing frame thereof by means of said articulation mechanism.

According to an expedient embodiment, the articulation mechanism or the protective cover is acted upon by the influence of a spring force and/or ballast weight, e.g. by means of a ballast weight on a lever arm, in the direction of the protective position so that the protective cover will automatically assume the protective position.

For automatically moving the protective cover to the passive position, the labelling unit, preferably the connector part thereof, has expediently provided thereon at least one actuating element which moves ahead of said connector part and which is oriented towards a counter stop of the protective cover or the articulation mechanism of the protective lid in the direction of the approach movement. During the approach movement, the actuating element displaces the protective cover to the passive position or in the direction of the passive position so that the subsequent establishment of the connection between the connector parts will not be impeded by the protective cover. Manipulations by hand are here not necessary. A safety aspect is involved as well, since in this phase of the movement, the free opening of the connector part on the docking station is already covered by the connector part on the labelling unit so that the hand of an operator cannot come into contact with live parts, neither intentionally nor unintentionally.

According to a structurally simple embodiment, the articulation mechanism comprises two forks which are pivotably supported on both sides of the connector part and between which the protective cover is mounted. At least one prong of the respective forks can be extended in length thus forming the counter stop. This prong is then acted upon by the labelling unit and its actuating element during the approach movement, whereby the protective cover will be displaced to the passive position by said approach movement.

According to a concrete embodiment, the opening of the connector part, which is mounted on the docking station in a substantially vertical orientation, can face upwards and additionally slope obliquely in the direction of the approach movement. The oblique opening can be flat or, and this is particularly expedient, it can be provided with a convex arc which matches with a complementary concave edge of the protective lid. The pivot axle of the protective lid, which extends essentially transversely to the approach movement and horizontally, is, in relation to the arc section of said opening, eccentrically positioned in such a way that the protective lid will rise from said opening as soon as it leaves the protective position. This reduces the resistance to movement of the protective lid, even if said protective lid was fixedly pressed onto the opening at the protective position. Furthermore, the eccentric positioning of the pivot axle has the effect that the protective lid will fixedly close the opening and seal it by means of the sealing frame, when it moves about the pivot axle and reaches the protective position, since it will come into contact with and forcefully close the opening.

In accordance with the above, the opening of the connector part arranged on the labelling unit can face downwards and can also match with the opening of the connector part on the docking station. The connector elements in both connector parts are positioned such that, when the connector elements are correctly coupled, the connector parts will be in mutually sealing contact with each other. It follows that also a correctly established connection will protect the connector elements against external influences.

In order to prevent the connector parts and the possibly sensitive connector elements from getting damaged, it may be expedient to provide on the docking station and the labelling unit centering devices for mutually aligning the respective connector parts and the respective connector elements thereof. These centering devices can be mandrels and sockets, which are preferably adapted to be aligned with one another by means of the approach movement and to be engaged with one another by means of the lifting and lowering movements, and which then guarantee that the connector elements are correctly brought into contact with one another.

According to an expedient embodiment, at least the connector element in the connector part on the docking station can be movably arranged, and a geared connection can be provided between the articulation mechanism of the protective cover and the connector element, said connector element being moved, during the movement of the protective cover to the passive position, by means of said geared connection to a connecting position for the connector element of the other connector part, said connecting position being raised relative to the connector part. On the other hand, if the connector elements are fixedly installed in the connector parts, the connector parts can engage one another so that the connector elements will be correctly connected to one another. In addition, a protective cover can also be provided on the connector part of the labelling unit, said protective cover being displaced in a similar way making use of the sequence of movements during docking and undocking.

BRIEF DESCRIPTION OF THE DRAWINGS

Embodiments of the subject matter of the present disclosure are explained making reference to the drawings, in which.

DETAILED DESCRIPTION OF THE PREFERRED EMBODIMENT

Figure 1:
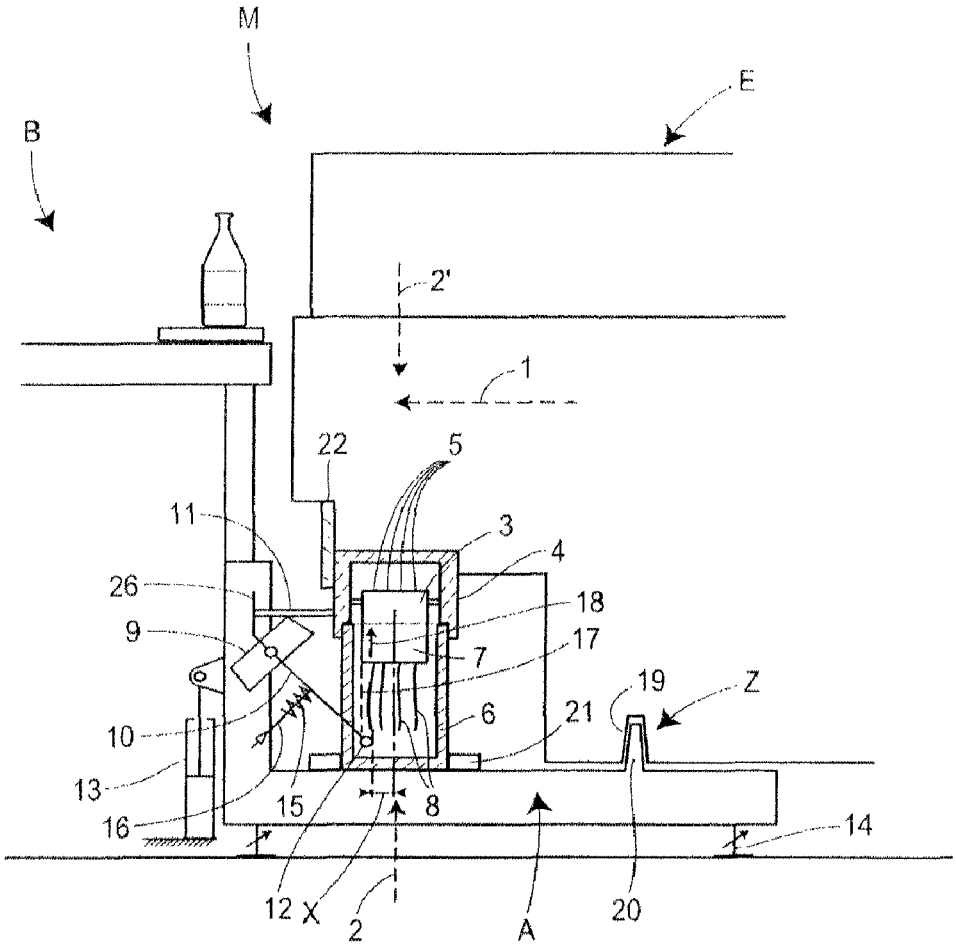
FIG. 1 shows a schematic section through part of a labelling machine with a labelling unit docked to a docking station and a media plug connection.

FIG. 1 shows part of a labelling machine M in a schematic representation, said labelling machine comprising a basic machine B, e.g. a bottle carousel which is not shown, a docking station A (a single one or one of a plurality of docking stations A which are circumferentially distributed around the basic machine B) and a labelling unit E connected at a target position.

On the basis of this modular configuration of the labelling machine M, containers F, such as bottles, transported in the basic machine B can have applied thereto labels from the labelling unit E.

The labelling unit E is moved to the docking position shown (target position at the basic machine B) with a predetermined sequence of movements, said sequence of movements comprising e.g. a substantially linear and horizontal approach movement in the direction of an arrow 1 and a substantially linear and, in this embodiment, vertical lifting movement of the docking station A in the direction of an arrow 2 and/or a vertical lowering movement of the labelling unit E in the direction of an arrow 2'. The approach movement 1 and the lifting and lowering movements 2, 2' are used for automatically establishing a media plug connection between a connector part 4 on the labelling unit E and a complementary connector part 6 on the docking station A. For undocking the labelling unit E, the sequence of movements is reversed and this reversed sequence of movements is used for separating the media plug connection.

The medium transferred through the media plug connection is e.g. only a supply current for a drive motor of the labelling unit E, the drive motor being not shown. It will, however, be expedient to simultaneously transfer a plurality of different media via the media plug connection, such as the electric supply current, pressurized air, hydraulic medium, water, electric signals or electric data messages and the like; in order to allow this, a plurality of media lines 5, 8 is connected to the respective connector parts 6, 4 and to media connector elements 3, 7 arranged therein.

In the embodiment shown, the connector part 4, which can be secured in position on the labelling unit E through fastening means 22, is oriented such that its opening faces downwards, whereas the connector part 6, which, making use of fastening means 21, is mounted on the docking station A in an essentially vertical orientation, is oriented such that its opening faces upwards in such a way that, in the connected condition of the labelling unit E shown in the figure, the connector elements 3, 7 are coupled to one another and the connector parts 4, 6 are, preferably sealingly, attached to one another.

At least the connector part 6 of the docking station A is provided with a protective cover 9, e.g. a protective lid, which, by means of an articulation mechanism 10, is adapted to be pivoted about a pivot axle 12 on the connector part 6, said protective cover 9 being pivotable between the passive position shown in FIG. 1 and a protective position which is not shown and which the protective cover 9 will automatically assume when the connector part 4 of the labelling unit E has been removed during the undocking operation.

For moving the protective cover 9 from the protective position, which is not shown, to the passive position which is shown in FIG. 1, the labelling unit E, i.e. the connector part 4, has provided thereon an actuating element 11 which moves ahead in the direction of the approach movement 1 and acts on a counter stop 26 of the articulation mechanism 10. The articulation mechanism 10 comprises e.g. (FIG. 2) forks 23 which are arranged on both sides of the connector part 6 and between which the protective lid defining the protective cover 9 is mounted, said forks 23 being pretensioned either by spring force 15 or/and by a ballast weight with an effective lever arm in a direction 16 towards the protective position.

The docking station A can either be set up on the ground on vertically adjustable support feet 14, the labelling unit E being then vertically adjusted by means which are not shown, or the base of the docking station A can be vertically adjustable through cylinders 13.

It will be expedient to provide between the labelling unit E and the base station A centering devices Z, e.g. mandrels 20 on the docking station, which are adapted to be inserted into sockets 19 provided in the lower surface of the labelling unit E and which guarantee that the connector parts 4, 6 are correctly brought together and that the connector elements 3, 7 are correctly coupled.

The pivot axle 12 for the articulation mechanism 10 is displaced to an extent x eccentrically to the center axis of the connector part 6 and to the center of the upper opening of the connector part 6 in such a way that the protective cover 9 will, under the force 15 acting thereon, sealingly and forcefully close the upper opening of the connector part 6 at the protective position which is not shown and will immediately be raised from the opening of the connector part 6, without rubbing thereon, when it leaves the protective position and moves in the direction of the passive position shown.

Figure 2:
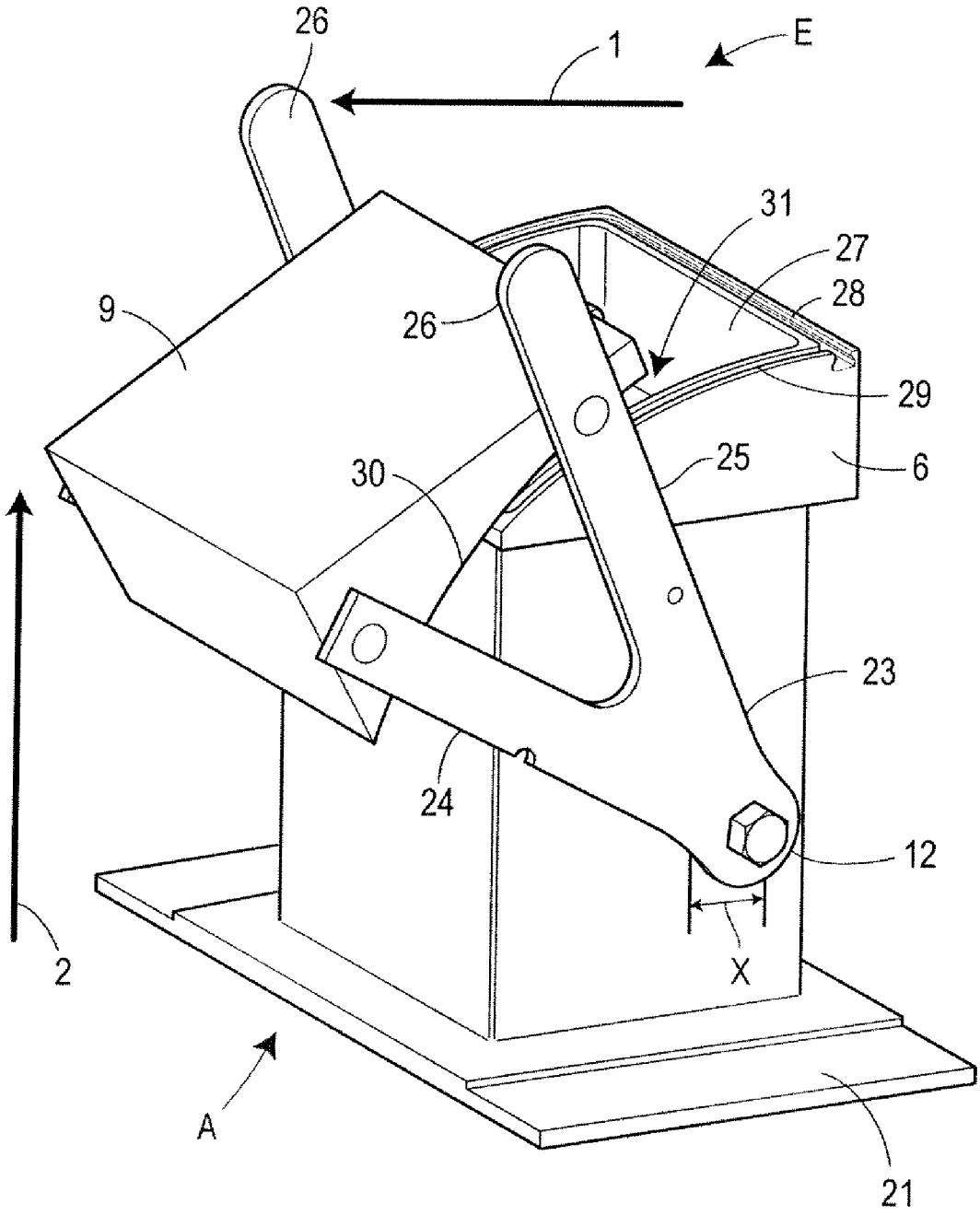
FIG. 2 shows a detail variant of a connector part on the docking station in the course of a docking movement.

The embodiment shown in FIG. 2 differs from the embodiment according to FIG. 1 primarily insofar as the opening of the connector part 6, which is designated by reference numeral 27, slopes obliquely in the direction of the approach movement 1, the slope being a convex arc 28 which also exists, in the form of a concave arc, on the edge 30 of the protective cover 9. Due to the fact that the pivot axle 12 is displaced to the extent x relative to the centre of the connector part 6 and of the opening 27, the edge 30 will be fixedly pressed onto the opening 27 when the protective cover 9 moves to the right in FIG. 2 up to and into the protective position. The upper side of the opening 27 has provided thereon e.g. a circumferentially extending elastic sealing frame 29. In FIG. 2, the opening 27 is surrounded by an upwardly directed duct 31 in which the connector element or elements 7, which are not shown here, are mounted.

The two forks 23 have two prongs 24, 25 on which the protective cover 9, which is implemented as a protective lid, is mounted, the prongs 25 being extended in length at the top so as to define counter stops 26 for the actuating element or elements 11 (cf. FIG. 1) so that the protective cover 9 will be suitably displaced during the approach movement 1 of the labelling unit E and expose the opening 27.

As an alternative solution, the connector element 7 is supported in the connector part 6 in a vertically movable manner in FIG. 1, and it is adapted to be displaced, e.g. by means of the articulation mechanism 10, in the direction of the arrow 18 via a geared connection 17 which is indicated by a broken line. When the protective lid has been moved to the protective position shown in FIG. 1, the connector element 7 has been raised via the geared connection 17 in the direction of the arrow 18 to such an extent that it is properly coupled to the connector element 3 in the connector part 4.

The oblique opening according to FIG. 2 may also be flat, and this also applies to the complementary edge 30 of the protective cover 9. It goes without saying that also the opening of the connector part 4 on the labelling unit E has a suitable concave shape in FIG. 2 so that the connector parts 4, 6 will seal said opening when the media plug connection has been correctly established.

In the docking process, the approach movement 1 can be used for bringing the mandrels 20 and the sockets 19 into alignment with one another, whereas the lifting movement 2 and the lowering movement 2' are used for inserting each mandrel 20 into its respective socket 19 and for properly connecting the connector parts 4, 6. At least conical mandrels 20 will facilitate the centering process.

When, during undocking of the labelling unit E, the sequence of movements is reversed, the connector parts 4, 6 are first separated from one another by the lifting and lowering movements 2, 2' until the labelling unit E is moved away in a direction opposite to the approach movement 1. This movement allows the protective cover 9, which is acted upon by the force 15, to automatically assume the protective position and seal the opening 27. The connector part 4 on the labelling unit E may be provided with a similar and similarly functioning protective cover, but, in view of its downward orientation, it may also remain uncovered.

The connector elements 3, 7 may e.g. be used only for establishing the current connection for the supply voltage or the supply current. As has already been mentioned, it is, however, expedient to transfer a plurality of media simultaneously via the media plug connection.

Figure 3:
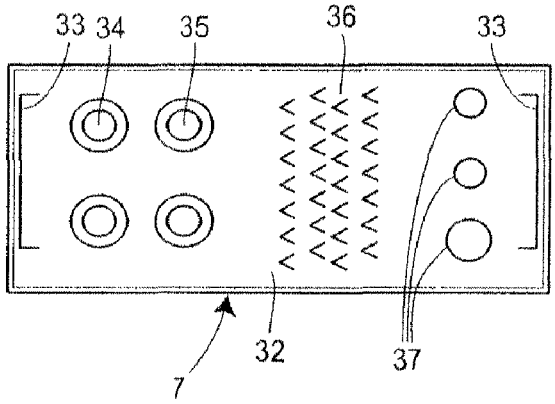
FIG. 3 shows a schematic top view of a connector element for establishing the media plug connection.

FIG. 3 shows in a schematic top view e.g. the connector element 7 of the connector part 6 on the docking station. When seen from above, the connector element 7 has an approximately rectangular shape and guide tongues 33 which are provided on both longitudinal ends of the rectangle and which are insertable into complementary apertures of the matching connector element 3 in the connector part 4 of the labelling unit E. A front surface 32 of the connector element 7 has placed thereon e.g. two contact pins 34 and two contact sockets 35, e.g. for the supply current. Adjacent said contact sockets 35, a group of contact tabs or contact pins 36 is provided for electrical signals and the like. Adjacent said contact tabs or pins 36, three connection sockets 37 are provided, e.g. for pressurized air, water and, if desired, for other media. The connector element 7 of the connector part 4, which is not shown, has a mirror-inverted structural design so that all the media can be transferred simultaneously when a proper connection has been established between the connector elements 3, 7.

I claim:

1. A labelling machine for containers, comprising a basic machine provided with at least one docking station for a labelling unit, the respective labelling unit being adapted to be docked to and undocked from a target position at the basic machine with a predetermined docking sequence of relative movements, the docking sequence of movements comprising an essentially linear approach movement of the labelling unit towards the docking station of the basic machine and an at least essentially linear, lifting movement of the docking station, and/or a lowering movement of the labelling unit, the lifting and lowering movements taking place approximately transversely to the approach movement, and several media connector parts which are arranged vertically on the basic machine and on the labelling unit, respectively, and which are adapted to be coupled to one another, the media connector parts being arranged and implemented on the labelling unit and the docking station with respect to the target position in such a way to be automatically coupled in the docking sequence of movements, to establish at least one media connection, and to be automatically decoupled in the undocking sequence of movements, wherein at least the media connector part arranged on the docking station is provided with a protective cover which is movable at least partially by the approach movement of said sequence of movements, between a protective position covering an opening of the media connector part and a passive position exposing said opening for automatically coupling the respective media connector elements accommodated in said media connector parts, said movements of the protective cover taking place during docking and undocking of the labelling unit, wherein each media connector element includes a plurality of media terminals, and each of the media connector parts defines a housing protecting the media connector element connected to a plurality of media lines, wherein the opening of the media connector part, which is mounted on the docking station in an at least substantially vertical orientation, faces upwards and slopes obliquely in the direction of the approach movement, wherein the protective cover has an edge which fits on the opening and is pivotable about the pivot axle arranged on the media connector part, which pivot axle extends transversely to the approach movement and horizontally and, in relation to said opening, is eccentrically positioned in such a way that the protective cover will raise from said opening as soon as it leaves the protective position, wherein the opening of the media connector part arranged on the labelling unit faces downwards and is implemented such that it fits onto, around or into the opening of the media connector part on the docking station, and wherein the media connector elements in both media connector parts are positioned such that, when the media connector elements are correctly coupled, the media connector parts mutually seal each other.

2. The labelling machine according to claim 1, wherein the movement by a docking sequence of movements is automatic.

3. The labelling machine according to claim 1, wherein the essentially linear lifting movement is essentially vertical.

4. The labelling machine according to claim 1, wherein the protective cover is a protective lid.

5. The labelling machine according to claim 1, wherein the opening faces upward and slopes obliquely one of linearly or along a convex arc.

6. The labelling machine according to claim 1, wherein the pivot axle is on the media connector part.

7. The labelling machine according to at claim 1, wherein the docking station and the labelling unit have arranged thereon engageable centering devices for mutually aligning the respective media connector parts and the respective media connector elements thereof.

8. The labelling machine according to claim 7, wherein the centering devices are mandrels and sockets on the labelling unit and on the docking station, which are adapted to be aligned with one another by means of the approach movement and to be engaged with one another by means of the lifting and lowering movements.

9. The labelling machine according to claim 1, wherein the protective cover is movably supported on the media connector part via an articulation mechanism, wherein, when moving to the protective position, the protective cover is adapted to be pressed by said articulation mechanism onto the opening of the media connector part or onto a sealing frame at said opening of the media connector part, wherein the articulation mechanism comprises two forks equipped with prongs which forks are pivotably supported on both sides of the media connector part and between which the protective cover is mounted, wherein at least one prong of each respective fork is extended in length thus forming a counter stop for engagement of the protective cover or the articulation mechanism, wherein one of the media connector parts of the labelling unit has provided thereon at least one actuating element which moves ahead of said media connector part in the direction of the approach movement and which is oriented towards said counter stop, wherein the media connector element in the one of the media connector parts on the docking station is movably arranged, and wherein a geared connection is provided between the articulation mechanism and the media connector element, said media connector element being movable by means of said geared connection and by means of the articulation mechanism relative to the media connector part to a connecting position for the media connector element of the media connector part of the labelling unit, when the protective cover is moved to said passive position by the approach movement of the labelling unit to the docking station.

10. The labelling machine according to claim 9, wherein the media connector part has provided thereon the at least one actuating element.

11. The labelling machine according to claim 9, wherein the articulation mechanism or the protective cover is acted upon by the influence of one or more of a spring force and a ballast weight in the direction of the protective position of the protective cover.

* * * * *